US005762169A

United States Patent [19]

Deliman et al.

[11] Patent Number: 5,762,169

[45] Date of Patent: Jun. 9, 1998

[54] RETRACTABLE AUXILIARY LUGGAGE CASE ATTACHMENT AND SECURITY TETHER MECHANISM AND METHOD

[75] Inventors: Lawrence J. Deliman, Aurora; Daniel G. Elles, Conifer; David W. Fiddes, Brighton; James S. Gregg, Aurora, all of Colo.; Rik Hillaert, Oudenaarde, Belgium; William L. King, Denver, Colo.; Jon C. Nordmark, Highlands Ranch, Colo.; Roger Pedlar, Denver, Colo.; Robert M. Tesman, Littleton, Colo.; Carlo Felice Zezza, Jr., Denver, Colo.

[73] Assignee: Samsonite Corporation, Denver, Colo.

[21] Appl. No.: 481,961

[22] Filed: Jun. 7, 1995

[51] Int. Cl.[6] ..... A45C 5/14; A45C 13/18; A45C 13/20; A45C 13/38

[52] U.S. Cl. ..... 190/101; 190/18 A; 190/102; 190/108; 150/102

[58] Field of Search ..... 150/101, 102, 150/10, 106; 190/12 A, 101, 102, 108

[56] References Cited

U.S. PATENT DOCUMENTS

| | | | |
|---|---|---|---|
| 103,781 | 5/1870 | Sargent . | |
| 156,484 | 11/1874 | Holbrook . | |
| 203,735 | 5/1878 | Hunter . | |
| 257,003 | 4/1882 | Harris . | |
| 359,219 | 3/1887 | Lyon . | |
| 746,617 | 12/1903 | Wenzell . | |
| 1,213,758 | 1/1917 | Delane | 150/106 |
| 1,862,665 | 6/1932 | Duorak | 150/106 X |
| 2,769,475 | 11/1956 | Fisher | 150/108 X |
| 3,982,613 | 9/1976 | Wood | 190/18 A X |
| 4,066,195 | 1/1978 | Dickler . | |
| 4,685,315 | 8/1987 | Comolli . | |
| 4,733,549 | 3/1988 | Baker | 190/101 X |
| 4,738,341 | 4/1988 | Asano | 190/101 |
| 4,756,171 | 7/1988 | Homar . | |
| 4,759,431 | 7/1988 | King | 190/101 |
| 4,792,026 | 12/1988 | Dimmick et al. | 190/101 |
| 4,979,598 | 12/1990 | Verheij et al. . | |
| 5,027,874 | 7/1991 | Gazzola | 150/108 |
| 5,156,028 | 10/1992 | Jiang . | |
| 5,294,029 | 3/1994 | Shimura et al. | 150/108 X |
| 5,311,972 | 5/1994 | Plath | 190/102 |
| 5,355,980 | 10/1994 | Hsieh | 190/18 A X |

FOREIGN PATENT DOCUMENTS

| | | | |
|---|---|---|---|
| 2608388 | 6/1988 | France | 150/108 |
| 2645416 | 10/1990 | France | 150/108 |
| 3830612 | 3/1990 | Germany | 190/101 |
| 4237364 | 5/1994 | Germany | 150/108 |
| 399017 | 9/1933 | United Kingdom | 190/101 |
| 2238955 | 6/1991 | United Kingdom | 150/108 |

*Primary Examiner*—Sue A. Weaver
*Attorney, Agent, or Firm*—Gregory W. O'Connor

[57] ABSTRACT

An auxiliary luggage attachment and security tether mechanism secure an auxiliary luggage case to a main luggage case for support on and by an exterior surface of a main luggage case, and secure at least the main luggage case to an object. The attachment mechanism comprises a clutch mechanism, an elongated flexible strap having an inner end fixably attached to the clutch mechanism and the outer end attached to a hook, the clutch mechanism being biased to pull the flexible strap onto the clutch mechanism and retract the hook to the clutch mechanism. A lid is pivotally mounted adjacent to the clutch mechanism and has a selectively open position where the hook and strap are accessible, and a selectively closed position where the lid covers the clutch mechanism and the strap or hook to the extent the strap is retracted onto the clutch mechanism. The lid engages the clutch mechanism in the open position to release the clutch mechanism whereby the strap can be extended from the clutch mechanism. The lid engages the clutch mechanism in the closed position to hinder the movement of the clutch mechanism and fix the length of extension of the strap. A lock mechanism in the lid locks the lid in the closed position, covering the clutch mechanism. The hook at the end of the strap can be replaced in the receptacle to engage the clutch mechanism, and the lid can then be locked to secure the hook and the strap to the clutch mechanism.

24 Claims, 7 Drawing Sheets

RETRACTABLE AUXILIARY LUGGAGE CASE ATTACHMENT AND SECURITY TETHER MECHANISM AND METHOD

This invention relates to luggage cases, and more particularly to a new and improved auxiliary luggage case attachment and security tether mechanism, and method, the mechanism being mounted on a main luggage case and used to secure at least the main luggage case to another object or to transport an auxiliary luggage case along with the main luggage case.

BACKGROUND OF THE INVENTION

Luggage cases have traditionally been transported by lifting the luggage using a carrying handle. More recently, however, particularly with larger pieces of luggage or those adapted to carry heavy articles, wheels have been mounted on the luggage case, and an auxiliary guide handle or pull tether has been used to push or pull the luggage case on its wheels. This type of wheeled luggage has met with considerable acceptance because greater weights can be transported with relative ease.

To take further advantage of the conveniences of wheeled luggage, devices have been developed for attaching an auxiliary luggage case to the wheeled main luggage case to allow several luggage cases to be transported simultaneously.

Auxiliary luggage attachment devices have been well received by travelers because they allow travelers to easily transport more than one luggage case at a time. Instead of carrying two luggage cases by hand, travelers can attach an auxiliary luggage case to a wheeled luggage case and simply pull the wheeled luggage case along the ground, thereby transporting both luggage cases at once with a minimal amount of effort. The auxiliary luggage attachment mechanism makes the effort involved in transporting the luggage through doors, in crowded passageways, and over long distances much less burdensome to the traveler.

Initially, the auxiliary luggage case attachment devices used fixed-length straps or expandable straps that were wrapped around the auxiliary luggage case as well as a portion of the wheeled luggage case to secure the two luggage cases together. These straps, however, were typically not permanently connected to the wheeled luggage case. The potential for misplacing the strap, the difficulty in adjusting the length of the strap, the inconvenience of having to separately store the strap, and the risk of losing the strap were all factors which discouraged use of these separate straps.

Removable devices attached to the main luggage case, such as straps or hooks, are also used for attaching auxiliary luggage cases to a main luggage case. However, removable devices also fail to fully satisfy users. Storing the removable device in the main luggage case is an inconvenience because the device consumes valuable packing space and is sometimes difficult to access when the main case is packed. Removing the device and storing it elsewhere creates an inconvenience because access to it is limited, and the device can easily be misplaced.

Devices permanently attached to a main luggage case for carrying auxiliary luggage also present issues related to convenient use. When the permanent attachment devices are not being used to attach an auxiliary luggage case, they often project from the case and pose the risk of breaking, snagging or otherwise catching other articles. The permanent nature of the attachment devices on the main luggage case can also make the case difficult to store.

A difficulty common to many of the attachment devices described above relates to the adjustment of the attachment device to accommodate differently-sized auxiliary luggage cases. Typically, where the attachment device includes a strap or a strap with a hook, the length of the strap must be adjusted. Adjusting the strap often requires manipulation of the strap and a clasp or buckle device. The degree of manipulation required often makes it very difficult for the user to adjust the strap in a convenient manner, particularly if the user is wearing gloves or is carrying other articles.

Attachment devices using hooks attached to the exterior of the main luggage case do not provide any adjustment for accommodating the varying sizes of auxiliary luggage cases. Because the hook is not adjustable, the auxiliary luggage case is often attached to the main luggage case in a position not optimal for balance and convenient transportation.

Another inconvenience common to many of the previously described attachment devices relates to storing the device when it is not in use. Often times the attachment device must be removed, folded or otherwise manipulated in an inconvenient manner before being stored. Any difficulty in storing the attachment device detracts from its overall utility.

While auxiliary luggage case carrying capability is a popular luggage feature, luggage security is becoming more important also. Many situations arise during travel in which luggage cases are susceptible to being stolen. Luggage cases are sometimes stolen when left unattended or when the traveler's attention is diverted. There are several situations during travel where a traveler must leave luggage unattended, such as when purchasing a ticket, using the rest room, or eating at a restaurant. Additionally, a traveler's attention is often diverted from the luggage even though the luggage is not left unattended. Making a phone call, napping, reading or conversing with another to pass the time sufficiently diverts the attention of the traveler to allow a luggage case to be stolen.

Security devices for luggage cases have been developed in an attempt to alleviate the problems associated with luggage theft. By using a security device, a traveler can more safely leave luggage cases unattended. The security device normally attaches the luggage case to any suitable object such as a chair, post or another luggage case. Security devices provide a sufficient level of security to deter would-be thieves and thereby give the traveler peace of mind.

The first security devices were separate from the luggage cases. Typically, the security devices included a fixed-length, flexible, elongated member having an end releasably attachable to the exterior of the luggage case, and a free end which was wrapped around an object and secured back to the luggage case or to itself. While effective during use, the separate security devices were inconvenient to apply, store, and retrieve. For instance, when not in use, the separate security device had to be stored in a location that did not interfere with the use of the luggage, yet had to be conveniently accessible to allow the traveler to use the device when desired. Further, they had to be attached to the exterior of the case, and a separate locking device had to be attached to the free end for reconnecting to the case or the member.

Recently, luggage case security devices have become more convenient to store and use. Security devices have developed to be extendable from and retractable into the main luggage case, making the security device easily accessible for use by the traveler. This later type of luggage case security device has made luggage case security devices more appealing to consumers by alleviating the problems of having to store a separate article and retrieve it from an inconvenient location.

It is with respect to these considerations and other background information relative to prior art luggage case security devices and auxiliary luggage attachment mechanisms that the significant improvements of the present invention have evolved.

SUMMARY OF THE INVENTION

One of the important aspects of the present invention relates to an auxiliary luggage case attachment and security tether mechanism which is permanently attached to a main luggage case to avoid problems of misplacing or losing it, which is extendable to the degree desirable to accommodate a variety of different types and sizes of auxiliary luggage, which is available for use independent of the other functionality of pull handles and the like of the main luggage case, which is automatically retractable, which is retractable when not in use to avoid problems of inconvenience, breakage, exposure and the like, which is able to be locked in any of an extended or retracted position, and which is capable of being used to secure at least the main luggage case to an object.

In accordance with these and other aspects, the present invention relates to a new and improved auxiliary luggage attachment and security tether mechanism, and associated method, for securing an auxiliary luggage case to a main luggage case for support on and by an exterior surface of a main luggage case, and for securing at least the main luggage case to an object.

The auxiliary luggage attachment and security tether mechanism, attached to the main luggage case, supports an auxiliary luggage case on the main luggage case, and secures the main luggage case to an object. The attachment mechanism comprises a clutch mechanism, an elongated flexible strap having an inner end fixably attached to the clutch mechanism and the outer end attached to a hook, the clutch mechanism being biased to pull the flexible strap onto the clutch mechanism and retract the hook to the clutch mechanism. A lid is pivotally mounted adjacent to the clutch mechanism and has a selectively open position where the hook and strap are accessible, and a selectively closed position where the lid covers the clutch mechanism and the strap or hook to the extent the strap is retracted onto the clutch mechanism.

The lid engages the clutch mechanism in the open position to release the clutch mechanism whereby the strap can be extended from the clutch mechanism. The lid engages the clutch mechanism in the closed position to hinder the movement of the clutch mechanism and fix the length of extension of the strap. A lock mechanism is positioned in the lid for locking the lid in the closed position.

Specifically, the lid has selectively first and second open positions where the hook and strap are accessible. The lid engages the clutch mechanism in the first position to release the strap so that the strap can be extended from the clutch mechanism. The lid engages the clutch mechanism in the second position to retract the strap whereby the strap is pulled into the clutch mechanism until the strap is taut.

The clutch mechanism comprises a spring-loaded rotatable shaft to which the inner end of the strap is attached and upon which the strap is wound and a gear and ratchet assembly fixably attached to the shaft. A dog is pivotally mounted on the clutch mechanism, the lid in the first position pivots the dog to disengage from the gear and ratchet assembly to allow the shaft to rotate to allow extension of the strap. A pawl is also pivotally mounted on the clutch mechanism, and the lid in the second position pivots the pawl to disengage from the gear and ratchet assembly to allow the spring-loaded shaft to rotate to further extend the strap or to retract the strap. The lid is disengaged from the dog and pawl in the closed position, and the dog and pawl are biased to engage the gear and ratchet assembly and prohibit the shaft from rotating.

In one embodiment, the attachment mechanism includes a housing which defines a receptacle, which in turn stores the clutch mechanism and strap. The lid, in the closed position, covers the receptacle, and in the open positions, uncovers the receptacle. The hook at the end of the strap can be replaced in the receptacle to engage the clutch mechanism, and the lid can then be locked in the closed position to secure the hook, and thus the strap, in the receptacle. If the strap is looped around a fixture, such as a lamp post or another luggage case, and the hook is then locked in the receptacle, the mechanism then acts as a security tether.

The invention also relates to a new and improved method of assembling an auxiliary luggage case attachment and security tether mechanism. The method comprises the steps of mounting an elongated shaft in a gear and rachet assembly by inserting a first end of the shaft into an axial recess of the gear and rachet assembly; attaching a first end of a flexible strap to the elongated shaft and winding the strap onto the shaft to produce a first subassembly containing the strap, shaft, and gear and rachet assembly; mounting the first subassembly into a housing by inserting the first subassembly through an aperture in a first end portion of first and second end portions making up the housing; mating the two end portions of the housing to form the housing and at the same time inserting a second end of the shaft through an aperture in the second end portion of the housing; mounting a spring cassette onto the second end of the shaft; pivotally mounting a dog to the first end portion in a position to engage and disengage from the gear and ratchet assembly; pivotally mounting the pawl to the first end portion in a position to engage and disengage from the gear and ratchet assembly; attaching a shroud defining a base portion and two elongated legs to a perimeter of the housing, the base and the legs surrounding the housing; and pivotally attaching a lid, having laterally opposing and outwardly extending pins, to the legs of the shroud.

A more complete appreciation of the present invention and its scope can be obtained from the accompanying drawings, which are briefly summarized below, the following detailed description of presently preferred embodiments of the invention, and the appended claims.

DETAILED DESCRIPTION

Figure 1:
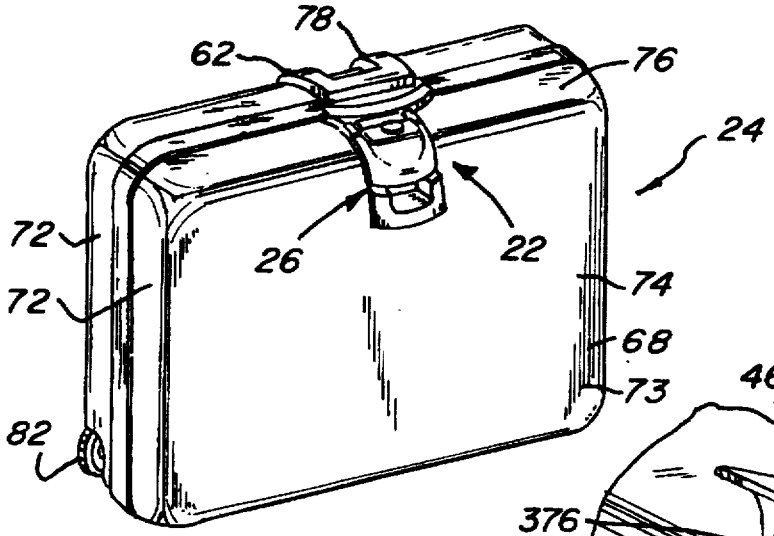
FIG. 1 is a perspective view of a wheeled luggage case having an auxiliary luggage attachment and security tether mechanism incorporating the present invention, shown with the attachment mechanism not in use.

An auxiliary luggage case attachment and security tether mechanism 22, which embodies one form of the present invention, is attached to a main luggage case 24 as shown in FIGS. 1–6. The attachment and security tether mechanism includes a housing 26, a strap 28, a hook 32, a clutch mechanism 34, and a lid 36. The housing 26 defines a receptacle 38 and is attached to the main luggage case 24. The clutch mechanism is positioned within the housing 26. The clutch mechanism 34 is able to rotate about a longitudinal axis within the housing 26.

The strap 28 is an elongated and flexible member having opposing inner and outer ends 42, 44. The inner end 42 of the strap 28 is attached to the clutch mechanism 34 to allow the strap 28 to wind around and unwind from the clutch mechanism 34 when the strap 28 is being retracted or withdrawn. The hook 32 defines a generally rigid J-shaped member and is attached to the outer end 44 of the strap 28. The strap 28 and hook 32 are operatively extendable from and retractable into the receptacle 38 by being unwound from or wound up onto, respectively, the clutch mechanism 34.

Figure 10:
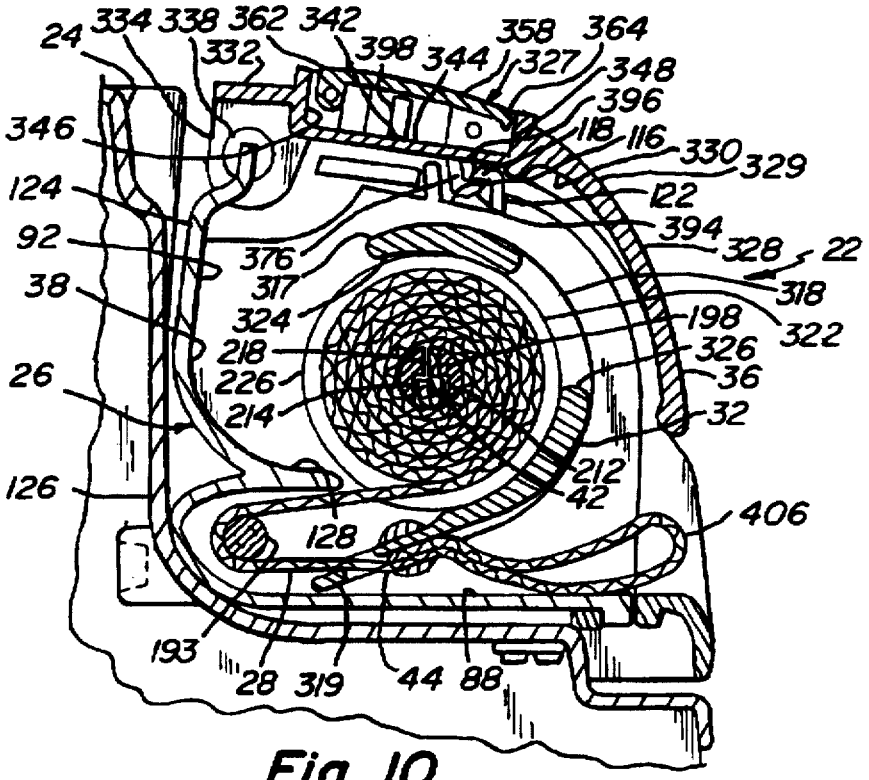
FIG. 10 is a section view of the attachment and security tether mechanism taken substantially in the plane of line 10—10 of FIG. 8, illustrating the strap wrapped around a shaft, and the hook encompassing and engaging the clutch mechanism.

Referring generally to FIGS. 1 and 10, when the attachment and security tether mechanism 22 is not in use, the strap 28 and hook 32 are contained within the receptacle 38 in the retracted position. In the retracted position the strap 28 is wound around the clutch mechanism 34 within the receptacle 38, and the hook 32 fits over the strap 28, facilitating convenient storage of the strap and hook. The lid 36 is pivotally attached to an upper edge 48 of the housing 26, and is able to pivot to a closed position substantially covering the receptacle regardless of the position of the strap 28 and hook 32. The lid 36 can be locked in the closed position by a locking mechanism 46.

Figure 4:
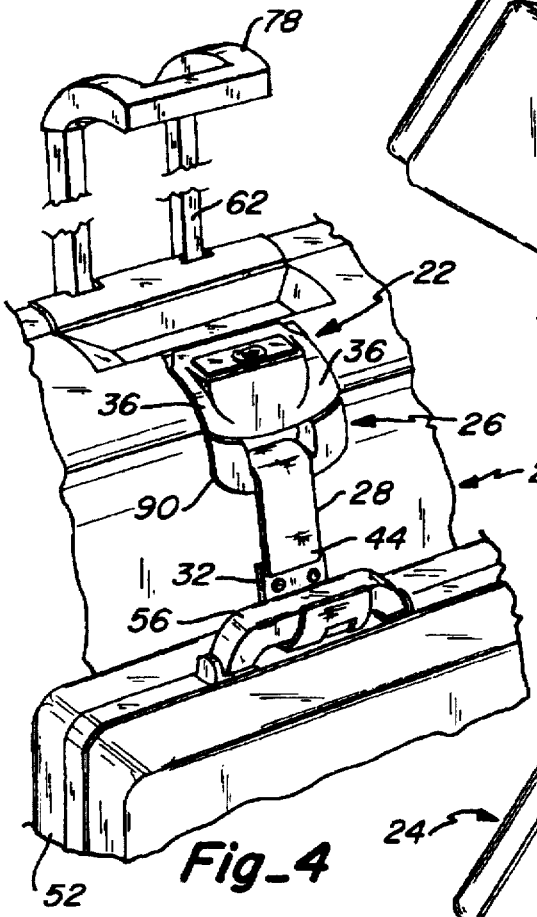
FIG. 4 is an enlarged partial perspective view similar to FIG. 3, illustrating the attachment and security tether mechanism supporting an auxiliary luggage case, and a pull handle extended from the wheeled luggage case.
Figure 5A:
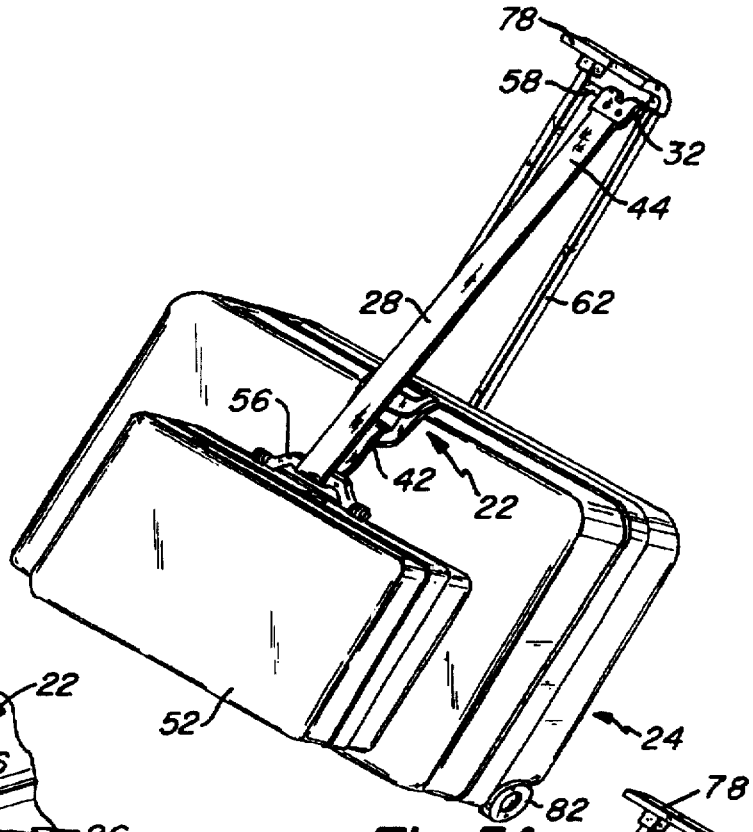
FIG. 5A is a perspective view of another alternative use of the attachment and security tether mechanism to support an auxiliary luggage case.
Figure 5:
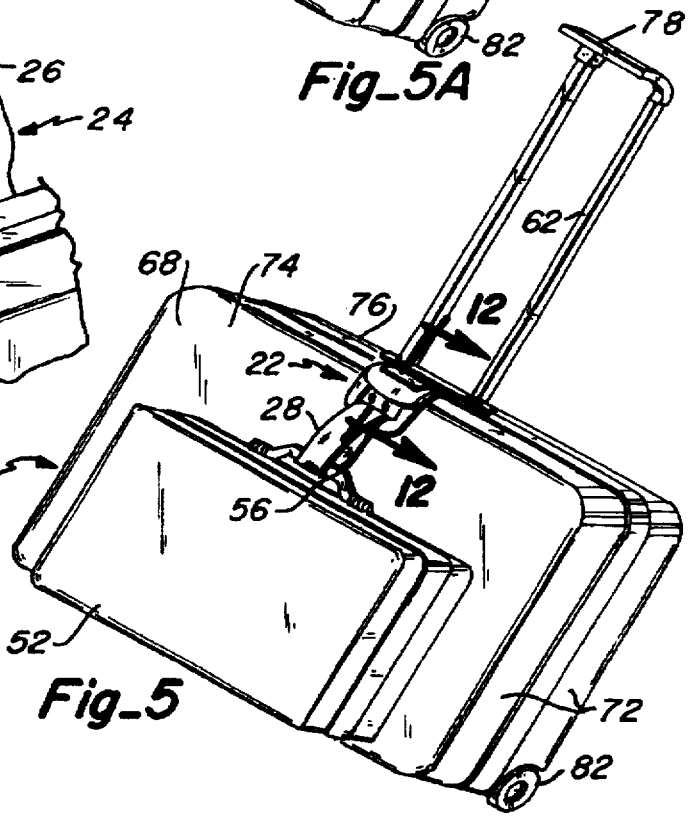
FIG. 5 is a perspective view of an alternative use of the attachment and security tether mechanism to support an auxiliary luggage case.
Figure 6:
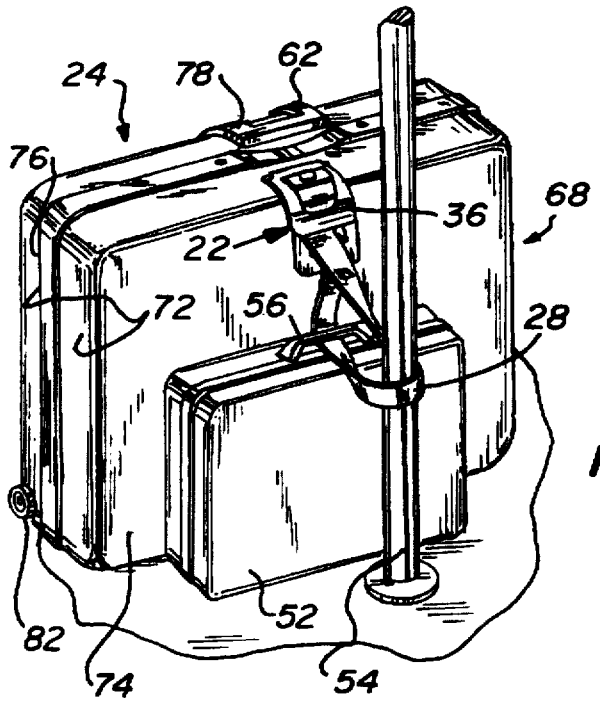
FIG. 6 is a perspective view of the wheeled luggage case as shown in FIG. 5, illustrating the use of the attachment and security tether mechanism to secure the wheeled luggage case and the auxiliary luggage case to an object.
Figure 8:
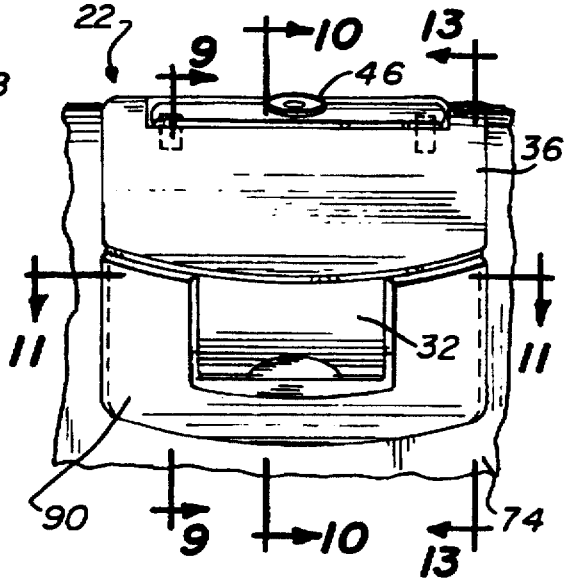
FIG. 8 is an enlarged elevation view of the attachment and security tether mechanism in a closed and retracted position.

To extend the strap 28, the lid 36 must be opened to allow the clutch mechanism 34 to rotate, unwinding the strap 28 and hook 32 from around the clutch mechanism 34. When extended, the strap and hook can be used to attach an auxiliary luggage 52 case to the main luggage case 24 as shown in FIGS. 4, 5 and 5*a*, attach the main luggage case to an object 54 for security reasons as shown in FIG. 6, or both. The clutch mechanism 34 allows the adjustment of the extension of the strap 28 to a desired length. The lid 36 can be left open to expose the receptacle 38, but is preferably closed over the receptacle, as shown in FIGS. 4 through 6, when the strap 28 and hook 32 are extended.

Referring generally to FIGS. 4, 5, and 5A, the attachment and security tether mechanism 22 functions as an auxiliary luggage case attachment mechanism in at least three ways. A first way is for the hook 32 to engage a portion of an auxiliary luggage case, such as a handle 56, to thereby support the auxiliary luggage case 52. The auxiliary luggage case 52 can also be supported directly by the strap 28. For instance, a length of the strap 28 is extended from the clutch mechanism 34 to loop around a portion of the auxiliary luggage case 52, and the hook 32 is then placed back in the receptacle 38 to engage the clutch mechanism 34. When the lid 36 is closed, the auxiliary luggage case 52 is then securely fixed to the main luggage case 24, as shown in FIG. 5. Alternatively, a length of strap 28 is extended from the clutch mechanism 34, looped around a portion of the auxiliary luggage case 52, and the hook 32 is then releasably attached to a crossbar 58 attached to a pull handle 62 when in an extended position, as shown in FIG. 5A.

Referring to FIG. 6, the attachment and security mechanism 22 also functions as a security device. If the user wishes to secure the main luggage case 24 to an object 54, such as a lamp post, the strap 28 can be extended from the clutch mechanism 34 and wrapped around the object 54, with the hook then being placed back within the receptacle to engage the clutch mechanism 34. The lid 36 is then closed and locked, denying unauthorized persons access to the receptacle 38 to disengage the hook 32 from the clutch mechanism 34. The strap 28 can be passed through the handles 56 of other auxiliary luggage cases 52, or any other suitable portion, to secure a plurality of luggage cases at the same time.

Figure 13:
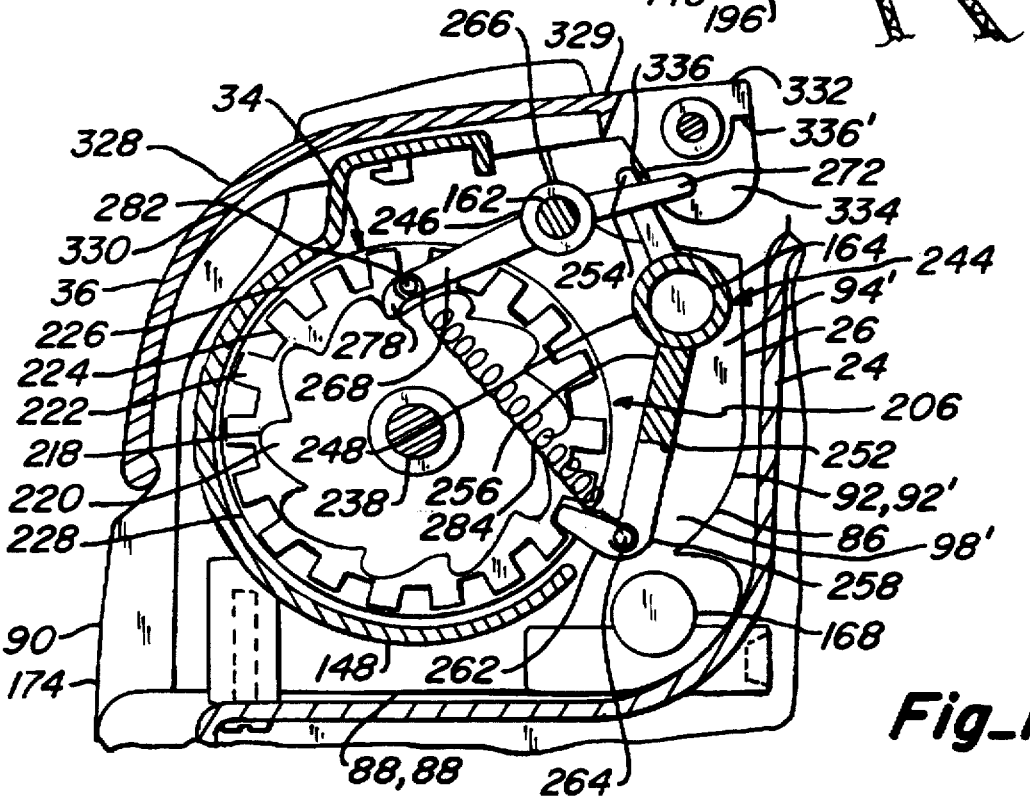
FIG. 13 is an enlarged section view of the attachment and security tether mechanism taken substantially in the plane of line 13—13 of FIG. 8, illustrating the engagement of a dog and pawl with a gear and ratchet assembly of the clutch mechanism when the lid is closed.
Figure 14:
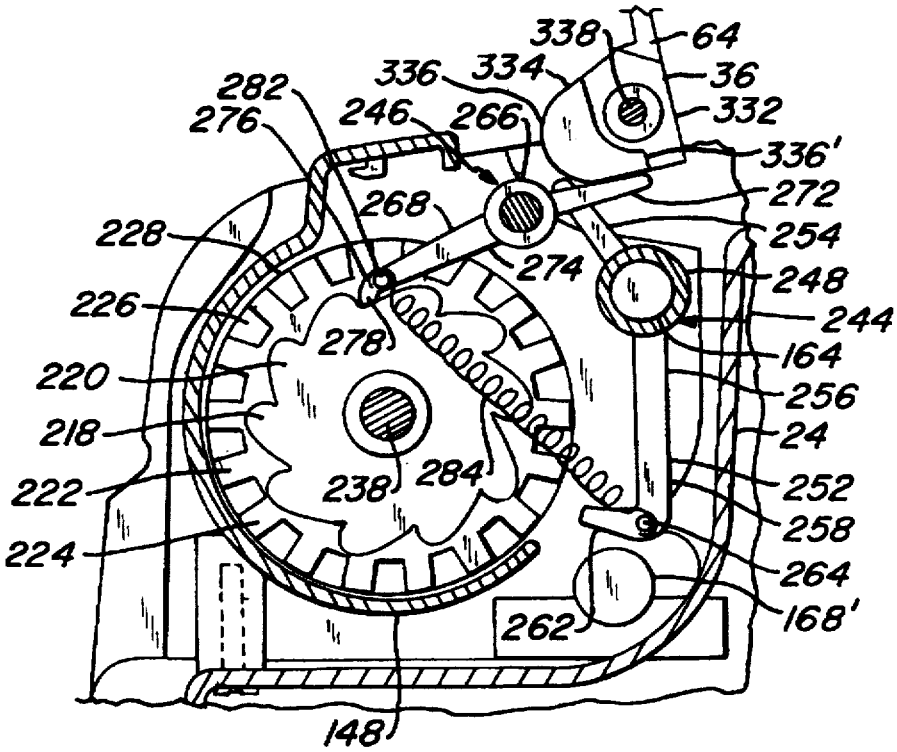
FIG. 14 is a section view of the attachment mechanism and security tether mechanism taken substantially in the plane of line 14—14 of FIG. 3, illustrating the engagement of cam surfaces on the lid with the dog and pawl when the lid is in a first open position.
Figure 15:
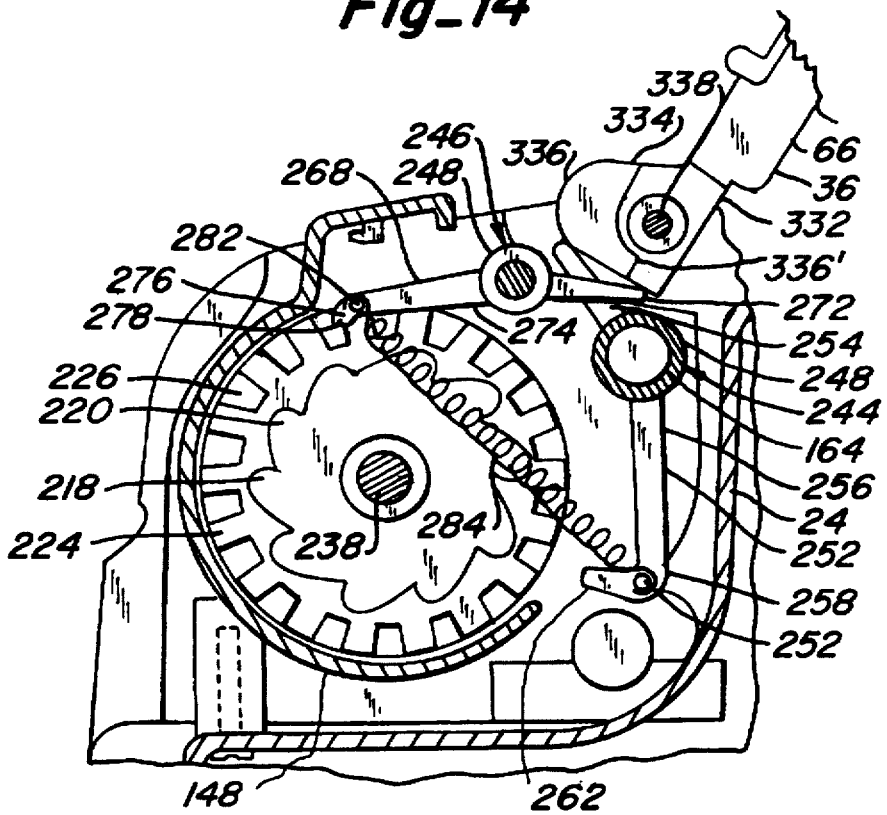
FIG. 15 is a section view of the attachment mechanism and security tether mechanism taken substantially in the plane of line 15—15 of FIG. 2, illustrating the engagement of cam surfaces on the lid with the dog and pawl when the lid is in a second open position.

The functionality of the attachment and security tether mechanism 22 is centered around the extension of the strap 28 and hook 32 from clutch mechanism 34, and the interaction of the clutch mechanism 34 with the lid 36. The position of the lid 36 controls the clutch mechanism 34, which in turn controls the extension and retraction of the strap 28 and hook 32. When the lid is pivoted to a first open position 64, as shown in FIG. 14, the clutch mechanism 34 allows the strap and hook to extend from the receptacle 38 but not to retract back into the receptacle 38. When the lid 36 is pivoted to a second open position 66, as shown in FIG. 15, the clutch mechanism 34 is biased to retract the strap until no slack is left in the strap 28. The strap can also be extended further when the lid is in the second position, subject to the retraction bias previously mentioned. When the lid 36 is in the closed position as shown in FIG. 13, the clutch mechanism 34 eliminates any further extension or retraction of the strap 28. The strap 28 and hook 32 are thus able to support an auxiliary luggage case 52 (FIGS. 4, 5, 5A) or to securely attach the main luggage case 24 to an object 54 (FIG. 6).

The luggage case 24 may be a conventional hard-sided suitcase having a main body 68 formed of two similar essentially rigid shells 72, each having an exterior surface 73, as shown in FIG. 1. Each shell has a large side face panel 74 and four perpendicular edge panels 76. A hinge (not shown) connected to the lower edge panels 76 pivotally connects the shells 72. A carrying handle 78 is attached to one shell 72 or at a centrally located position on a top facing edge panel 76 to allow the luggage case 24 to be carried in a conventional manner.

A pair of roller wheels 82 are rotatably mounted at the bottom of one of the edge panels 76. The wheels 82 engage a support surface, such as the floor, to allow the luggage case 24 to be rolled rather than carried at the user's option. The pull handle 62 is selectively extendable from, and retractable into, the interior of the case at a side face panel 74 as shown in FIGS. 1 and 5. The pull handle 62, when extended, is used for pulling or maneuvering the main luggage case 24 on the wheels 82. The pull handle 62 is retractable for storage when the luggage case 24 is not being maneuvered on the wheels 82 by the user.

Having explained the general structure and function of the present invention, the structural details, as shown in FIGS. 2 through 15, of the auxiliary luggage case attachment and security tether mechanism 22 will now be described. The attachment and security tether mechanism is located at or adjacent to the intersection of one large face panel 74 and a top edge panel 76 of the main luggage case 24, as shown in FIGS. 1 through 5.

Figure 7:
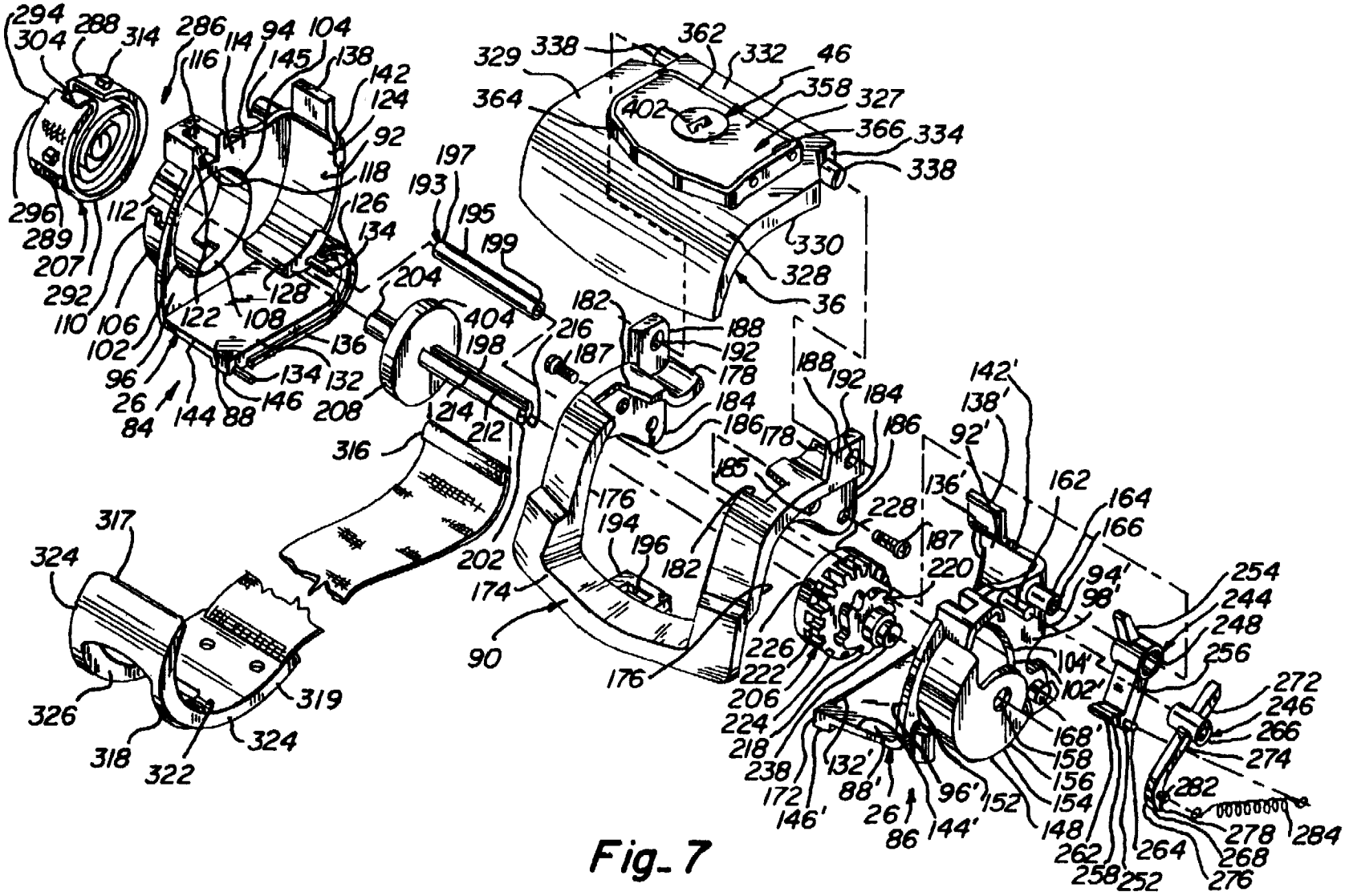
FIG. 7 is an exploded view of the attachment and security tether mechanism.

Referring to FIG. 7, the housing 26 comprises opposing end portions 84, 86 and a shroud 90. End portion 84 includes a base wall 88, a rear wall 92, and a side wall 94. The side wall has an inner surface 96 and an outer surface 98, and the side wall defines a circular aperture 102 having a perimeter 104. A cylindrical wall 106 extends substantially perpendicularly to the outer side 98 of the side wall 94 and is attached about the perimeter 104 of the aperture 102. The cylindrical wall 106 has a proximate end 108 attached to the outer side 98 of the side wall 94, and a distal end 110 projecting away from the proximate end. A plurality of similarly oriented L-shaped notches 112 (two are shown in FIG. 7) are formed in the cylindrical wall 106 and open at the distal end 110. At an upper portion 114 of the side wall 94, an inwardly and upwardly open recess 116 is defined, with a lip 118 extending perpendicularly rearwardly from a front wall 122 of the recess 116. The inner surface 96 of the side wall 94 also defines a cylindrical recess 168 positioned below the ledge 128, which extends from the outer surface 98 (not shown).

The rear wall 92 of the end portion 84 defines an integrally formed upper portion 124 and lower portion 126 which meet to form a ledge 128 extending forwardly over the base wall 88. The upper portion of the rear wall 92 has a slight arcuate shape, while the lower portion 126 of the rear wall 92 has a severe arcuate, or concave shape. The base wall 88 and the rear wall 92 define a continuous inner edge 132. A plurality of cylindrical elongated pins 134 are fixedly attached to the inner edge 132 and extend perpendicularly therefrom. The inner edge 132 defines an elongated ridge 136 extending perpendicularly from the inner edge 132 along most of the length of the inner edge 132. A tab 138 is integrally formed with the rear wall 92 adjacent to an upper end 142 of the rear wall 92, and extends upwardly from the upper end 142. The base wall 88 of the first portion 84 defines a front edge 144. A tab 146 is formed integrally with the base wall 88 and extends downwardly therefrom adjacent to the intersection of the inner edge 132 and the front edge 144. A hollow cylindrical pin 145 extends perpendicularly outwardly from the outer surface 98 of the side wall 94. The hollow pin defines an internally threaded cylindrical cavity 147.

The other end portion 86 of the housing 26 includes a base wall 88', a rear wall 92' and a side wall 94'. The side wall 94' has an inner surface 96' and an outer surface 98'. The sidewall 94' defines a circular aperture 102' having a perimeter 104'. A wall 148 is fixably attached along portions of the perimeter 104' of the aperture 102' and extends perpendicularly outwardly from the outer surface 98' to form a partial cylinder. The wall 148 has a proximate end 152 which is attached to the outer surface 98' of the side wall 94', and a distal end 154. An end wall 156 is fixably attached to and extends between and along the distal end 154 of the wall 148 to partially cover the aperture 102' in the side wall 94'. An axial circular aperture 158 is formed through the end wall 156.

A solid cylindrical pin 162 and a hollow cylindrical pin 164 each extend perpendicularly outwardly from the outer surface 98' of the side wall 94'. The hollow pin 164 defines an internally threaded cylindrical cavity 166.

The rear wall 92' defines an integrally formed upper portion 124' and lower portion 126' which meet to form an inwardly extending ledge 128' (not shown) that laterally corresponds to the ledge 128 on the first portion 84 of the housing 26. A tab 138' is integrally formed with the rear wall 92' adjacent to an upper end 142' of the rear wall 92', and extends upwardly from the upper end 142'. An inwardly and upwardly open recess 116' is formed at an upper portion 114' of the side wall 92', and has a rearwardly extending lip 118'0 covering a portion of the recess 116'. The recess 116' laterally opposes the corresponding recess 116 formed in the other portion 84.

Figure 11:
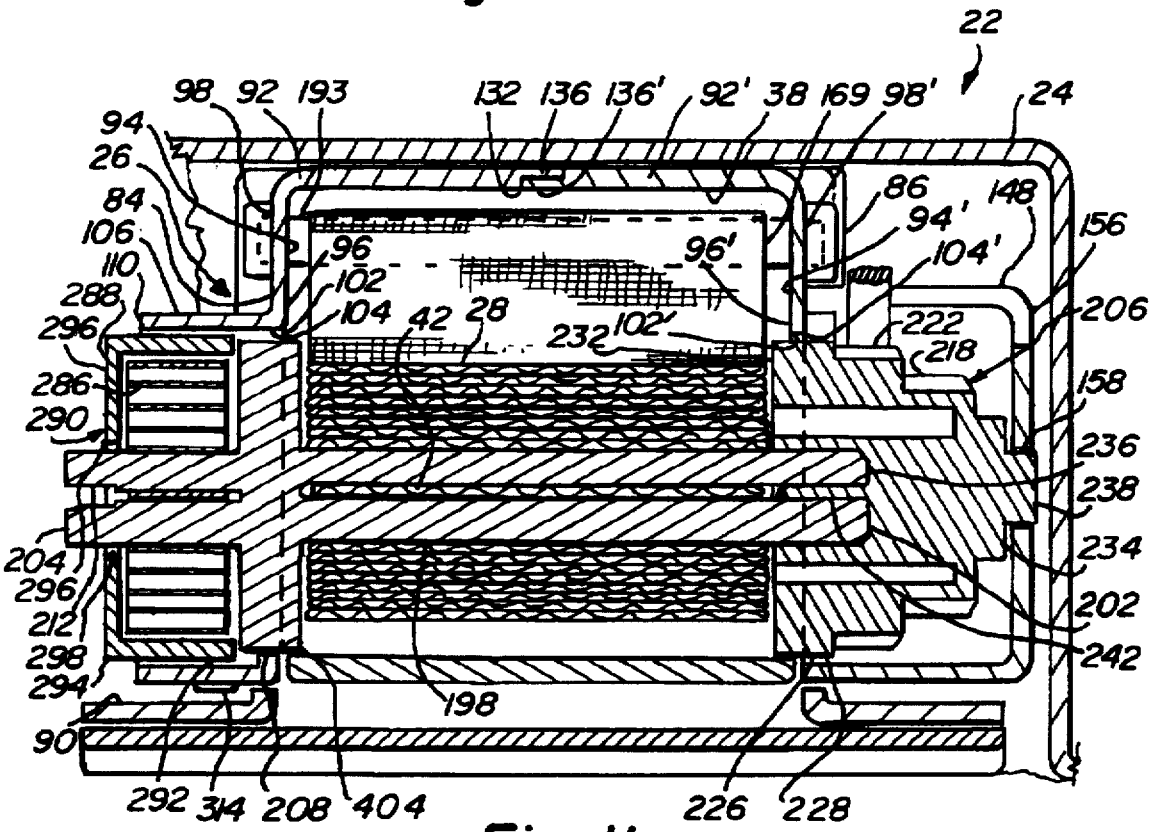
FIG. 11 is a section view of the attachment and security tether mechanism taken substantially in the plane of line 11—11 of FIG. 8.

Referring still to FIG. 7, and more generally to FIG. 10 and 11, the base wall 88'0 and the rear wall 92' together form a continuous inner edge 132'. An elongated ridge 136' extends inwardly from the inner edge. A plurality of recesses 172 (not shown) are formed along the inner edge 132'0 to receive the opposing pins 134 of the first end portion 84 located at corresponding positions. The base wall 88' of end portion 86 defines a front edge 144'. A tab 146' is formed integrally with and extends downwardly from the base wall 88' adjacent to the intersection of the inner edge 132'0 and the front edge 144'. The inner surface 96' of the side wall 94' defines a cylindrical recess 168' corresponding in location and laterally opposed to the cylindrical recess 168 formed on the side wall 94 of the end portion 84. The cylindrical recess 168' extends outwardly from the outer surface 98' of side wall 94'.

The shroud 90 is generally U-shaped and defines a base portion 174 integrally formed with two laterally opposing upwardly extending legs 176. Each leg 176 has a distal end 178, and each has a similar arcuate shape. The upwardly extending legs 176 each define an inwardly open laterally opposing notch 182 at their distal ends 178. Laterally opposing downwardly extending tabs 184, each defining a plurality of apertures 186, are integrally formed at the distal end 178 of the legs 176. A tab 188 extends perpendicularly upwardly from the distal ends 178 of each of the legs 176. The tabs 188 laterally oppose one another with each tab defining an aperture 192. A collar 194 extends rearwardly from the center of the base portion 174 of the shroud 90, and defines a vertically oriented aperture 196.

Referring to FIGS. 7 and 11, in assembling the end portions 84, 86 and shroud 90 to form the housing 26, the portion 84 and the portion 86 are oriented to engage each other along the inner edges 132, 132'. The inwardly extending pins 134 on the portion 84 are received by the recesses 172 formed in the other end portion 86, while the ridges 136, 136' along the inner edges 132, 132' of both portions 84, 86 overlap and engage one another to provide positional stability of each portion 84 and 86 relative to the other.

When portion 84 and portion 86 are attached together, they form the receptacle 38 defined by a base wall 88, 88', a rear wall 92, 92', and opposing side walls 94, 94'. The rear wall and the base wall of the receptacle 38 are simply the combination of the rear walls 92, 92' and base walls 88, 88' of the two end portions 84 and 86.

The shroud 90 fits over the housing 26 and assists in holding the two portions 84, 86 together. The downwardly depending tabs 146, 146' extending from the base walls 88, 88' are adjacent to one another when the portions 84, 86 are attached together. The adjacent tabs 146, 146' fit snugly within the aperture 196 formed by the rearwardly extending collar 194 formed on the base portion 174 of the shroud 90. The legs 176 of the shroud 90 resiliently flex laterally away from one another to allow the apertures 186 of the shroud 90 to receive the outwardly extending pins 145 and 164, which are used in conjunction with a fastener 187 inserted through the aperture 186 and threadedly received into the threaded cylindrical cavities 147 and 166 in the outwardly extending pins 145 and 164, respectively. The tabs 146 and 146' are restrained in the aperture 196, while the pins 145, 164 are received in apertures 186 when the legs 176 flex back to their normal position. The portions 84 and 86 are thus locked together to form the receptacle 38.

A tension bar 193 extends across the receptacle 38 when the housing 26 is assembled. The tension bar 193 comprises an elongated cylindrical rod 195 having opposing ends 197, 199, each end being received within one of the cylindrical recesses 168 formed on the inner surfaces 96 and 96' of the side walls 94 and 94' of the portions 84 and 86 of the housing 26. The recesses 168 hold the tension bar in position.

Referring to FIGS. 7, 9, 12 and 13, the clutch mechanism 34 comprises an elongated substantially cylindrical rigid shaft 198, having a first and second opposing ends 202, 204, a combination gear and ratchet assembly 206 attached to the first end 202 of the shaft 198, and a spring cassette 207 attached to the second end 204 of the shaft. A rigid disc 208 is attached concentrically to the shaft in a fixed perpendicular orientation, and is adjacent to but spaced away from the second end 204. A slot 212 having two widths 214, 216 bisects the shaft along its length into two portions except where the shaft is attached to the disc 208. The greater width 214 is contiguous to one side of the shaft 198 while the smaller width 216 is contiguous along the opposite side of the shaft.

The combination gear and ratchet assembly 206 comprises a generally circular ratchet 218 integrally formed with a gear 222 which is integrally formed with a circular disc 226. The ratchet 218 has saw-tooth shaped teeth 220, while the gear 222 has square-cut teeth 224. The circular disc 226 defines a smooth perimeter 228. The ratchet 218, the gear 222, and the disc 226 are all centered about the same axis.

The disc 226 is oriented towards an inner side 232 of the gear and ratchet assembly 206, while the ratchet 218 is oriented towards an outer side 234 of the gear and ratchet assembly 206, thereby sandwiching the gear 222 between the two. An inner side 232 of the gear and ratchet assembly 206 defines an axial cylindrical recess 236. The outer side 234 of the gear and ratchet assembly 206 defines a cylindrical shaped axially oriented extension 238. The axially oriented cylindrical recess 236 on the inner side 232 of the gear and ratchet assembly 206 has a tab 242 (FIG. 11) formed at one end thereof. The recess 236 receives the first end 202 of the shaft 198 and maintains a fixed rotational orientation therewith because the tab 242 within the recess 236 engages the slot 212 at the first end 202 of the shaft 198 when the shaft is inserted into the recess 236.

Referring to FIGS. 7 and 13–15, the gear and ratchet assembly 206 further comprises a dog 244 and a pawl 246. The dog 244 releasably engages the gear 222, while the pawl 246 releasably engages the ratchet 218, as described in more detail hereinafter. The dog 244 comprises a hollow cylindrical pivot bearing body 248 having an arm 252 extending substantially radially from the bearing body 248. A second straight lever arm 254 extends substantially radially from the bearing body 248. The arm 252 defines a general L-shape having a proximate end 256 fixably attached to the cylindrical bearing body 248, and a distal end 258 defining a tab 262 extending at a substantially right angle from the length of the arm 252. A pin 264 is fixably attached to and extends outwardly from the distal end 258 of the L-shaped arm 252.

The pawl 246 comprises a hollow cylindrical pivot bearing body 266 having an arcuate shaped arm 268 extending radially from the bearing body 266. A straight lever arm 272 also extends substantially radially from the bearing body 266. The arcuate shaped arm 268 defines a proximate end 274 fixably attached to the cylindrical bearing body 266, and an opposing distal end 276. The distal end 276 of the arcuate shaped arm 268 defines a tab 278 extending from the arm 268. A pin 282 is fixably attached and extends outwardly from the distal end 276 of the arcuate shaped arm 268. The gear and ratchet assembly 206, when attached to the shaft 198 and assembled in the attachment and security tether mechanism 22, is rotatably positioned within the partial cylindrical wall 148 and is partially covered by the end wall 156, as explained hereinafter.

The cylindrical bearing body 248 of the dog 244 pivotally receives the hollow cylindrical pin 164 extending outwardly from the outer side 98' of the sidewall 94' of the second portion 86. The hollow cylindrical bearing 266 of the pawl 246 pivotally receives the solid cylindrical pin 162 extending from the outer surface 98' of the side wall 94' of the second portion 86 to form a pivotable relationship. When connected in this manner, the dog 244 and pawl 246 engage the gear 222 and ratchet 218, as will be further described hereinafter.

A spring 284 under tension is affixed between the pin 264 extending from the distal end 258 of the dog 244 and the pin 282 extending from the distal end 276 of the pawl 246. The tension spring 284 acts to bias the distal ends 258 and 276 of the L-shaped arm 252 and arcuate shaped arm 268 towards one another, which will be further described hereinafter.

Figure 9:
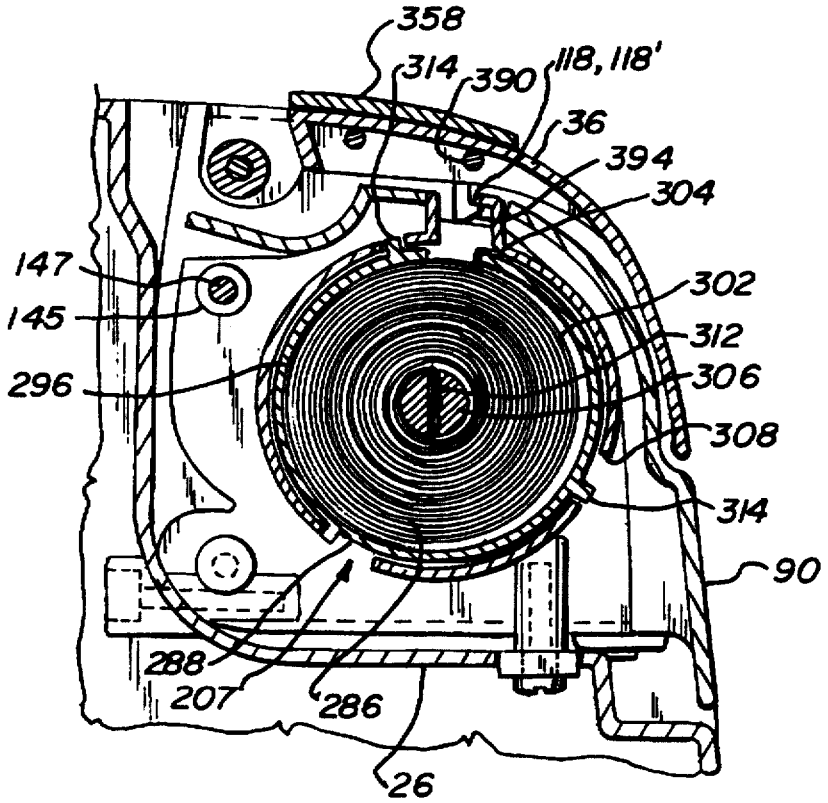
FIG. 9 is an enlarged section view of the attachment and security tether mechanism taken substantially in the plane of line 9—9 of FIG. 8, illustrating a coil spring attached to a shaft of the clutch mechanism.

Referring generally to FIGS. 7, 9, and 11, the spring cassette 207 is attached to the end 204 of the shaft 198 opposite the ratchet and gear assembly. The spring cassette 207 comprises a spring 286 positioned within a hollow cylindrical container 288 having an inner end 292 and an outer end 294. The outer end 294 of the cylindrical container 288 defines a wall 296 having an axially oriented aperture 298 formed therethrough. The inner end 292 of the cylindrical container 288 is open, exposing the spring 286. The spring 286 is a coil spring comprising a length 302 of strip metal having an outer 304 and an inner 306 ends. The spring 286 is wound in concentric spirals about an axis and is restrained within the cylindrical container 288. The outer end 304 of the spring 286 is crimped to engage an edge of a notch 308 formed in the wall of the cylindrical container 288 to anchor the spring 286 thereto. An inner end 306 of the spring 286 is bent to form a tab 312. The spring 286 is under a load when it is coiled and positioned within the cylindrical container 288. A plurality of keys 314 extend radially outwardly from the wall of the cylindrical container 288, as will be further described hereinafter.

The spring cassette 207 is attached to the second end 204 of the shaft 198. The tab 312 at the inner end 306 of the spring is inserted into the slot 212 at the second end 204 of the shaft. The functional purpose of the spring 286 with respect to the shaft 198 is described in greater detail hereinafter.

Figure 3:
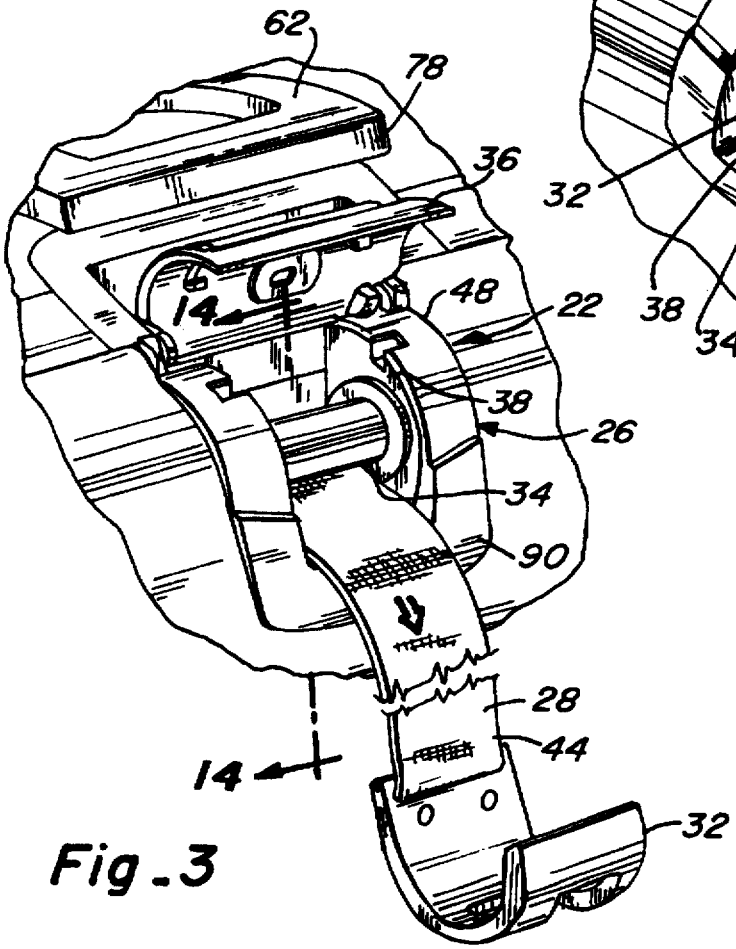
FIG. 3 is an enlarged partial perspective view similar to FIG. 2, illustrating a clutch mechanism and an extended strap attached to the clutch mechanism at an inner end and attached to the hook at an outer end.

Referring generally to FIGS. 3, 7, and 10, the strap 28 is an elongated flexible member, preferably made of woven nylon webbing. The inner end 42 of the strap 28 is overlapped on itself and sewn to define a hem 316 having a thickness of about twice that of the rest of the strap 28. The inner end 42 of the strap is releasably attached to the shaft 198 by inserting the strap 28 through the slot 212 in the shaft 198, and positioning the hem 316 at the inner end 42 of the strap 28 within the large width 214 of the slot 212 in the shaft 198. The hem 316 thus engages the interface between the large width 214 of the slot 212 and the narrow width 216 of the slot 212, and restricts any further motion of the strap 28 through the slot 212. The strap 28 is thus fixed to the shaft 198 and is capable of winding around the shaft 198 as the shaft rotates about its longitudinal axis. The strap 28 is attached to the shaft 198 before the clutch mechanism 34 is placed into the receptacle 38. The outer end 44 of the strap 28 is fixably attached to the hook 32.

The hook 32 has a general rigid J-shape defining a tip 317 and a base 319. The J-shape defines a convex outer side 318, a concave inner side 322, and laterally opposing edges 324. The hook defines a finger-hole aperture 326 formed adjacent to the tip 317.

Referring to FIGS. 7 and 10–15, the lid 36 comprises a rigid plate 328 having an upper surface 329, a lower surface 330, and a base portion 332. The base portion 332 has downwardly depending, laterally opposing extensions 334, one of which forms a plurality of cam surfaces 336, 336' as hereinafter further described. The downwardly depending extensions 334 also each define an outwardly extending cylindrically-shaped pin 338. Each of said pins 338 are pivotally received in the correspondingly located apertures 192 formed in the tabs 188 extending upwardly from the legs 176 of the shroud 90. The lid 36 is thus pivotally attached to the shroud 90, and can pivot from a closed position where the plate 328 substantially covers the receptacle 38, to at least one open position.

Figure 12:
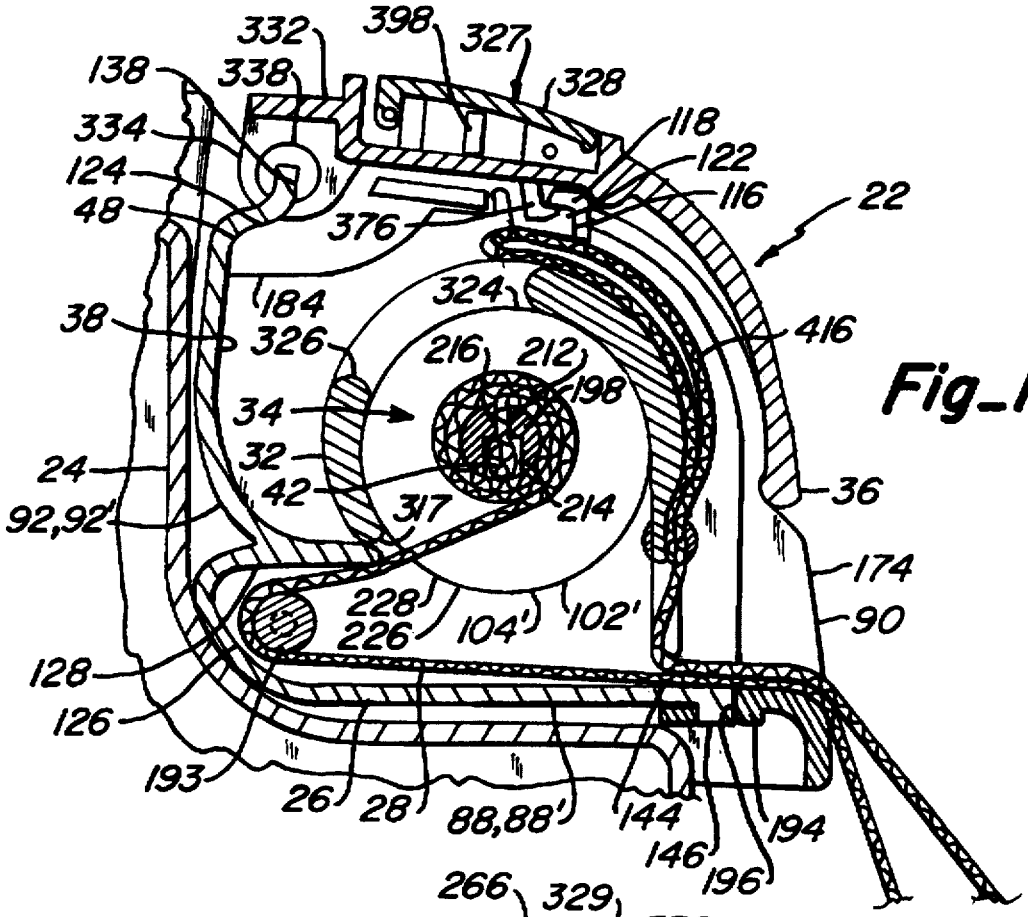
FIG. 12 is an enlarged section view of the attachment and security tether mechanism taken substantially in the plane of line 12—12 of FIG. 5, illustrating the engagement of the hook with the clutch mechanism when the strap is used to support an auxiliary luggage case.

A latch 327 releasably holds the lid 36 in the closed position as shown in FIGS. 10 and 12. The latch 327 is built into the lid 36. In a preferred embodiment, the upper surface 329 of the lid 36 defines a shallow recess 342 having a base wall 344, a back wall 346, a front wall 348, and opposing side walls 352. A press-plate 358 fits within the walls of the recess 342, and defines a rear edge 362, a front edge 364, and opposing side edges 366. The press plate 358 is mounted within the recess to pivot about its rear edge 362.

Figure 2:
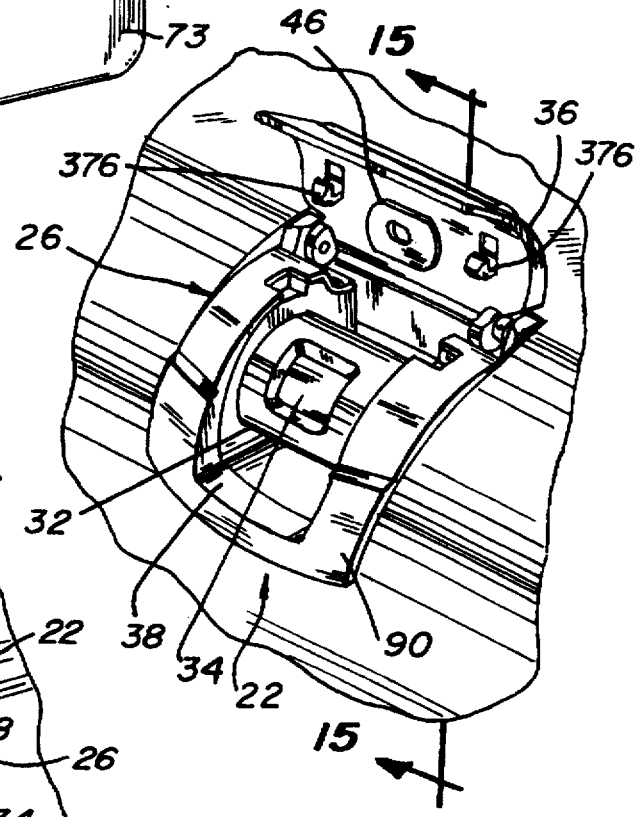
FIG. 2 is an enlarged partial perspective view of the wheeled luggage case shown in FIG. 1, illustrating a lid, a latch on the lid, a shroud, a hook, a strap, and a clutch mechanism.

A pair of latching pawls 376 are pivotally mounted to the rigid plate 328 and depend from the lower surface 330. The latching pawls are in laterally opposed locations to correspond to the opposing recesses 116 and 116' formed at the top of the sidewalls 94, 94' when the lid is in the closed position (FIG. 2). The latching pawls comprise a main body 378 defining a downwardly depending L-shaped extension 384.

The latching pawls 376 are biased to a forward position, as shown in FIGS. 9 and 10. When the press plate 358 is actuated by a user pressing downwardly on the front edge 364 of the press plate 358, the press plate 358 contacts the latching pawls 376 and pivots the latching pawls 376 to cause the L-shaped arm 384 to move to a rearward position. When the press plate 358 is released by the user, the latching pawls 376 pivot to return to the forward position.

The lid 36 is releasably latched in the closed position by the engagement of the L-shaped arms 384 with the lips 118 and 118' which partially cover the open recesses 116 and 116'. When the press plate 358 is depressed causing the L-shaped arm 384 to pivot in the rearwardly direction, the L-shaped arm 384 disengages the lip 118, 118' and allows the lid 36 to pivot to at least one open position.

The latching pawls automatically re-engage the lips 118, 118' when the lid is pivoted to the closed position. Each L-shaped arm 384 of each latching pawl 376 defines a downwardly facing angled surface 394. Each lip 118 and 118' each defines an upwardly facing angled surface 396. As the lid is pivoted to the closed position, the angled surface 394 engages the angled surface 396, causing the L-shaped arm to pivot in a rearward direction. When the lid is in the closed position, the angled surfaces 394 and 396 become disengaged, and the L-shaped arm 384 pivots back to the forward position and engages the lip 116 and 116', resulting in the lid being held in the closed and latched position.

The locking mechanism 46 comprises a block 398 actuated by a key barrel 402 (FIG. 7). When a key (not shown) is inserted into the key barrel 402, the key barrel 402 can be rotated to position the block 398 to prohibit the depression of the press plate 358. Thus, depression of the press plate 358 cannot cause the latching pawls 376 to pivot rearwardly and disengage from the lips 118 and 118'.

As shown in FIG. 9, the spring cassette 207 is generally received within the cylindrical wall 106 when the spring cassette 207 is mounted on the shaft 198. When mounting the spring cassette 207 onto the shaft 198, the second end 204 of the shaft 198 is inserted through the aperture 102 in the side wall 94 of the end portion 84 of the housing 26. The slot 212 in the end 204 of the shaft 198 engages the tab 312 formed at the inner end 306 of the spring before the keys 314 extending from the cylindrical container 288 are inserted into the L-shaped notches 112 formed in the wall 106. Since the inner end 306 of the spring 286 is held in a fixed position by the engagement of the tab 312 with the slot 212 on the shaft 198, the cylindrical container 288 can then be rotated about its longitudinal axis to either further load (wind up) the spring 286 or unload (unwind) the spring.

Once the load has been adjusted to the desired level, the spring cassette 207 is pushed further onto the shaft 198 while the keys 314 are aligned with and inserted into the notches 112, as shown in FIG. 9. The engagement of the keys 314 in the notches 112 fixes the orientation of the spring cassette 207 within the cylindrical wall 106 and sets the load on the spring 286 at the determined level. The engagement of the keys 314 with the notches 112 is typically called a "bayonet mount."

The cylindrical container has a knurled outer surface 289 to permit a user to easily grip the cylindrical container when setting the load on the spring cassette. The end wall of the cylindrical container of the power spring cassette may also define a plurality of apertures (not shown) for receiving corresponding tool members (not shown) to allow the user to set the load on the power spring cassette with a tool rather than by use of the user's fingers.

Referring to FIG. 11, when the clutch mechanism 34 is assembled with the housing 26, the shaft 198 extends across the receptacle 38 of the housing 26. A peripheral edge 404 of the disc 208 mounted near the second end 204 of the shaft extends into the receptacle, and a portion of the perimeter of the disc 226 on the inner side of the gear and ratchet assembly also extends into the receptacle 38. The tension bar 193 extends across the receptacle 38 when the housing 26 is assembled.

Referring generally to FIGS. 10, 12 and 13, the strap 28 extends from the shaft 198 rearwardly and downwardly to loop around the tension bar 193, and then extends forwardly out of the receptacle 38. This threading sequence helps provide for smooth extension and retraction of the strap 28 from the shaft 198. The tension bar also greatly reduces the potential of the strap winding up on the shaft incorrectly, such as loosely or out of lateral alignment. The tension bar 193 also helps support the weight of an auxiliary luggage case 52 by directing the force of the weight of the auxiliary case towards the back of the housing and away from the front portion of the housing.

Continuing with FIG. 11, the shaft 198 is supported in a rotational relationship within the receptacle 38 by its first end 202 and second end 204 being journalled in the respective apertures 156 and 298. The first end 202 is fixed within the gear and ratchet assembly 206, as described above, and the cylindrical extension 238 from the outer side 234 of the gear and ratchet assembly 206 is rotatably inserted into and through the aperture 158. The second end 204 of the shaft is supported in a rotational relationship by rotatable insertion into and through the aperture 298 defined in the cylindrical container 288 of the spring cassette 207. Both ends of the shaft 198 are effectively journalled within the respective apertures 158 and 298, allowing the shaft 198 to rotate about its longitudinal axis to retract and extend the strap therefrom.

To facilitate an understanding of the operation of the present invention, the assembly of the attachment and security tether mechanism 22 is now described.

First, the strap 28 is attached to the shaft 212 by inserting the inner end 42 of the strap 28 into the slot 212 in the shaft 198. Preferably, the strap 28 is then wound around the shaft 198, as shown in FIG. 10. The gear and ratchet assembly 206 is then attached to the shaft 198 by inserting the first end 202 of the shaft 198 into the axial recess 236 formed on the inner side 232 of the gear and ratchet assembly. The slot 212 in the shaft 198 engages the tab 242 formed in the recess 236 to prohibit the shaft 198 from rotating independently from the gear and ratchet mechanism 206.

Next, the portions 84 and 86 are oriented to engage one another along inner edges 132 and 132', respectively, to form the housing 26, which defines the receptacle 38. When the portions 84 and 86 are formed together, the shaft 198 with the gear and ratchet assembly 206, and the tension bar 193 are within the receptacle 38. The opposing ends 197 and 199 of the tension bar 193 are inserted into the cylindrical recesses 168 and 168', respectively, as the portions 84 and 86 are joined together. The tension bar 193 is thus held in position. Also, as the portions 84 and 86 are joined together, the gear and ratchet assembly is inserted through aperture 102' formed in side wall 94'. The cylindrical extension 238, formed on the outer side 234 of the gear and ratchet assembly 206, is also inserted into aperture 158 formed in end wall 156 of the wall 148 extending outwardly from aperture 102'. The extension 238 is rotationally journalled in the aperture 158.

The spring cassette 207 is then mounted on the second end 204 of the shaft 198. The spring 286 is positioned in the spring cassette 207 such that the second end 204 of the spring 286 is received in the axial aperture 298 formed in the end wall 296 of the spring cassette 207. The inner end 306 of spring 286 is positioned for engagement with the shaft 198. The spring cassette 207 is then oriented with the second end 204 of the shaft 198 to insure that the tab 312 on the inner end 306 of the spring 286 engages the slot 212 when the shaft 198 is inserted through the spring. Once the inner end 306 of the spring 286 is engaged in the slot 212, the spring cassette 207 can be rotated about its axis to load or unload the spring 286 as previously described.

The spring cassette 207 is then further mounted onto the second end 204 of the shaft 198 to cause the keys 314 to engage the L-shaped notches 112 formed on cylindrical wall 106. The engagement of the keys 314 in the L-shaped notches 112, forming a bayonet mount, fixes the spring cassette 207 within the cylindrical wall 106 and does not allow the spring cassette to be pulled off of the shaft 198, or to rotate to affect the load on the spring 286. The second end 204 of the shaft 198 is rotationally journalled in the aperture 298, supporting the shaft 198 and allowing the shaft to rotate therein.

The dog 244 and pawl 246 are then pivotally mounted on the hollow cylindrical pin 164 and solid cylindrical pin 162, respectively, to engage the gear 222 and ratchet 218, respectively. The spring 284 is then attached from the pin 264 extending from the dog 244 to the pin 282 extending from the pawl 246 to bias the dog and pawl to engage the gear 222 and ratchet 218, respectfully.

The shroud 90 is then placed over the end portions 84 and 86 to assist in holding the end portions together, and at the same time pivotally engages the lid to allow it to pivot from the closed position to the open positions 64 and 66. The adjacent tabs 146 and 146' extending from each of the end portions 84 and 86 are positioned into the aperture 196 formed in the collar 194 extending from the base 174 of the shroud. The legs 176 of the shroud 90 are flexed apart to allow the apertures 186 formed in the tabs 184 extending from the legs 176 to become aligned with the hollow pins 145 and 164 (on the outer side of the dog 244). The fastener 187 is then inserted through each of the apertures 186 and is threadedly received within the pins to attach the shroud 90 to the portions 84 and 86. The pin 162 is inserted into aperture 185 on the outer side of the pawl 246.

While the legs 174 are flexed outwardly, the pins 338 formed on the base portion 332 of the lid 36 are oriented to align with the apertures 192 formed in the tabs 188 extending upwardly from the legs 174. When the legs 174 are released to resume their normal position, the pins 338 are pivotally inserted into the apertures 192 to form a pivot joint about which the lid can pivot.

The auxiliary luggage attachment and security tether mechanism 22 is thus assembled and is ready to be mounted onto a main luggage case 24.

In operation, the attachment and security tether mechanism 22 is capable of performing several functions, each of which is related to the interaction between the lid 36, the clutch mechanism 34, and the strap 28 and hook 32. Referring generally to FIGS. 9 through 14, the different interactions between these components are shown. In the closed position, as shown in FIG. 10, the entire length of the strap 28 is wound around the shaft 198, and the hook 32 is placed into the receptacle 38 such that concave inner side 322 of the hook surrounds the strap wound on the shaft. The lateral edges 324 of the hook engage the portions of the discs 208, 226 extending into the receptacle.

In the retracted position, the base 319 of the hook 32 extends rearwardly under the shaft 198 and towards the tension bar 406. A finger loop 406 comprising a loop of the strap 28 attached at the base 319 of the hook 32, extends outwardly towards the front of the receptacle 38 to provide the user with a convenient handle with which to pull the hook 32 out of the receptacle 38 when the attachment and security tether mechanism 22 is to be used.

In the closed position, the lid 36 is pivoted into a downward position to substantially cover the receptacle 38, and also the strap 28 and hook 32 if therein. In the closed position the lid 36 is latched and cannot be opened unless the press plate 358 is actuated to release the latch pawl 376 from the recesses 116. The lid 36 can be locked in the closed position by actuating the lock mechanism 46, which disables the press plate 358, as previously described.

As shown in FIG. 13, when the lid 36 is in the closed position, the cam surfaces 336, 336' depending from the base 332 of the lid 36 do not engage either of the lever arms 254, 272, respectively. Because there is no engagement between the cam surfaces 336, 336' and the lever arms 254, 272, the distal ends 258, 276 of the L-shaped arm 252 and the arcuate shaped arm 268 are biased towards one another by the tension spring 284 to engage the gear 222 and ratchet 218, respectively. Specifically, the engagement of the distal end 258 of the dog 244 that engages the square cut tooth gear 222 prohibits the shaft 198 from rotating about its axis in either direction.

To remove the strap 28 and the hook 32 from the receptacle 38, the user must pivot the lid 36 into either the first open position 64 (FIG. 14) or the second open position 66 (FIG. 15). With the lid 36 open, the user can access the hook 32 and strap 28 from within the receptacle 38. At the first open position 64, as shown in FIG. 14, the cam surface 336 on the lid engages the lever arm 254 of the dog 244 and causes the dog 244 to pivot about its pivot joint 248 and release the distal end 258 of the L-shaped arm 252 from engagement with the square cut tooth gear 222. The disengagement allows the strap 28 to be withdrawn, and the strap unwinds from the shaft 198 causing the shaft to rotate counterclockwise with reference to FIG. 14. The pawl 246 engaging the shark tooth ratchet 218 does not interfere with the unwinding of the strap 28 from the shaft 198 because the distal end 276 of the pawl 246 slides along the gradual slope of each gear tooth 220 to allow the shaft 198 to rotate about its longitudinal axis in the counterclockwise direction. As the strap 28 is being withdrawn and the shaft 198 rotates in the counterclockwise direction, the spring 286 is wound up, causing the load on the spring to increase. The increased load on the spring in turn increases the force of the spring 286 attempting to turn the shaft 198 in a clockwise direction to retract the strap 28.

The pawl 246 prohibits the shaft 198 from rotating in the clockwise direction, with reference to FIG. 14, when the lid 36 is pivoted to a first open position 64. The distal end 276 of the pawl 246 engages the abrupt surface on the teeth 220 of the shark tooth ratchet 218 which prohibits the shaft 198 from rotating in the clockwise direction.

To allow the spring 286 to retract the strap 28 by driving the shaft 198 in the clockwise direction, the lid 36 must be pivoted to a second further open position 66, as shown in FIG. 15. The lid 36 in the second further open position 66 is pivoted further past the position occupied in the first open position 64 to a nearly vertical or past vertical orientation relative to the attachment and security tether mechanism 22. The base portion 332 of the lid 36 engages tabs 138, 138' when the lid is in the second open position 66. The tabs 138, 138' restrict the lid from opening any further. Pivoting the lid 36 to this position causes cam surface 336' on the lid 36 to engage the lever arm 272 on the pawl 246, while the first cam surface 336 is in continued engagement with the lever arm 254 on the dog 244. The engagement of the cam surface 336' with the lever arm 272 causes the pawl 246 to pivot about its pivot joint 266 and disengaged the distal end 276 of the pawl 246 from the shark tooth ratchet 218. With neither the pawl 246 nor the dog 244 engaging the ratchet 218 or gear 222, respectively, the spring 286 is then able to cause the shaft 198 to rotate in the clockwise direction to retract the strap 28 and wind it around the shaft 198 until the strap 28 is fully retracted, any slack in the strap is taken up, the lid 36 is moved back to the first position 64, or the lid 36 is closed.

The attachment and security tether mechanism 22 allows the user to carry an auxiliary luggage case 52 in one of three ways. Referring to FIG. 4, the first is to support the auxiliary luggage case 52 by the hook 32. The user first pivots the lid 36 to the first open position 64 to engage the cam surface 336 with the lever arm 254 which disengages the dog 244 from the gear 222 and allows the strap 28 to be withdrawn. The appropriate length of strap 28 is withdrawn from the clutch mechanism 34 and the lid 36 is closed to disengage the first cam surface 336 from the lever arm 254 and allow the tension spring 284 to bias the dog to engage the square cut gear 222. The length of extension of the strap 28 is thus fixed. The hook 32 can then be engaged with a portion of the auxiliary luggage case 52 to support the weight of the auxiliary luggage case.

Referring to FIG. 5, the second manner of carrying an auxiliary luggage case 52 is to loop the strap 28 around a portion of the auxiliary luggage case 52 and place the hook 32 back into the receptacle 38 of the attachment and security tether mechanism 22. The hook 32 surrounds the shaft 198, and the lateral edges 324 of the hook 32 are supported on the inner edges of the discs 208, 226 extending inwardly from the side walls 94, 94'. The tip 317 of the hook 32 also engages the ledge 128 extending forwardly from the rear wall 92, 92' of the receptacle (FIG. 12). The engagement of the tip 317 and the ledge 128 helps prevent the shaft 198 from carrying the entire weight of the auxiliary luggage case(s) 52. Closing the lid 36, as described above, fixes the length of the strap 28.

Referring to FIG. 5A, the third manner by which to support an auxiliary luggage case 52 requires the hook 32 and strap 28 to be withdrawn from the receptacle 38, looped around a portion of the auxiliary luggage case 52, and extended up to the cross bar 58 adjacent to the pull handle 62, which the hook is then attached to. Closing the lid 36 fixes the length of the strap 28 at that point.

In all three of these attachment scenarios, the strap 28 and hook 32 can be returned to the retracted position within the receptacle 38 by disengaging the strap 28 or hook 32 from the auxiliary luggage case, and pivoting the lid 36 to the second open position 66. In the second open position 66, the second cam surface 336' on the lid engages the lever arm 272 on the pawl 246 and causes the pawl 246 to disengage from the shark tooth ratchet 218 which in turn allows the spring 286 to rotate the shaft 198 in a clockwise direction and retract the strap 28 by winding it about the shaft 198. Also, the strap 28 length can be shortened after the auxiliary luggage case has been attached by pivoting the lid to the second open position.

The attachment and security mechanism 22 is also utilized as a security device by pivoting the lid 36 to either the first 64 or second 66 open position, withdrawing the strap 28 and hook 32 from the receptacle 38, looping it around an object 54, replacing the hook 32 into the receptacle 38, closing the lid 36, and actuating the lock mechanism 46. The hook 32 is thus locked inside the receptacle 38 and cannot be removed without opening the lid 36. The hook 32 engages the clutch mechanism 34, as described above, and shown in FIG. 12, to provide a secure restriction of the hook 32 in the receptacle 38. The strap 28 could be looped through or around several other objects 54 to secure more than one luggage case at a time.

A presently preferred embodiment of the present invention and many of its improvements have been described with a degree of particularity. This description has been made by way of a preferred example. It should be understood, however, that the scope of the present invention is defined by the following claims, and not necessarily by the detailed description of the preferred embodiment.

The invention claimed is:

1. A luggage case capable of carrying auxiliary luggage cases, and also capable of being secured to an object, the luggage case comprising:

a main body having an exterior surface, said exterior surface defining an interior cavity, said main body having a selectively openable and closeable opening to allow access to the interior cavity;

a handle fixedly attached to said main body for use in transporting the luggage case; and an auxiliary luggage attachment and security tether mechanism mounted on said main body, said mechanism comprising:

a housing defining a receptacle;

a clutch mechanism fixed in the receptacle;

an elongated flexible strap having an inner and an outer end, the inner end fixably attached to the clutch mechanism;

a hook attached to the outer end of the strap;

a lid pivotally attached to the housing adjacent to the receptacle and having a selectively first and second open positions where the receptacle is accessible, and having a selectively closed position where the lid covers the receptacle, the lid including cam surfaces positioned for engaging the clutch mechanism in the first and second open positions, and for being disengaged from the clutch mechanism when in the closed position; and wherein in the closed position the extension of the strap is fixed, and wherein in the first open position the strap can be extended from the clutch mechanism, and wherein in the second open position the strap can be extended from and retracted onto the clutch mechanism.

2. A luggage case as defined in claim 1, wherein said luggage case rests on a support surface, the luggage case further comprising:

a pair of wheels mounted on said main body and selectively engageable with said support surface to transport said main body along the support surface.

3. A luggage case as defined in claim 2, wherein:

said main body comprises two shells, each shell having a side face panel and four edge panels integrally formed with and extending substantially perpendicularly from said side face panel, said four edge panels defining a perimeter;

said shells releasably connected along said perimeters; and said mechanism attached to said shell adjacent to an intersection of said side face panel and one of said four edge panels.

4. An auxiliary luggage attachment and security tether mechanism for supporting an auxiliary luggage case on a main luggage case, and for securing at least the main luggage case to an object, said attachment and security tether mechanism being attached to the main case, and comprising:

a housing defining a receptacle;

a clutch mechanism mounted to and within the receptacle;

an elongated flexible strap having an inner and an outer end, the inner end attached to the clutch mechanism;

a hook attached to the outer end of the strap;

a lid attached to the housing adjacent to the receptacle and having selectively first and second open positions where the receptacle is accessible, and having a selectively closed position where the lid covers the receptacle;

the lid including a cam surface positioned for engaging and disengaging from the clutch mechanism in the first and second open positions, and for being disengaged from the clutch mechanism when in the closed position; and wherein in the closed position the clutch mechanism prevents extension of the strap from the clutch mechanism, and wherein in the first open position the strap can be extended from the clutch mechanism, and wherein in the second open position the strap can be extended from and retracted onto the clutch mechanism.

5. An auxiliary luggage attachment and security tether mechanism as defined in claim 4, wherein the clutch mechanism is spring loaded to automatically retract the strap onto the clutch mechanism when the lid is in the second open position.

6. An auxiliary luggage attachment and security tether mechanism as defined in claim 5, wherein the clutch mechanism further comprises:

an elongated rotatable shaft to which the strap is attached and upon which the strap is wound and unwound; and a spring cassette attached to the shaft to provide rotational biasing.

7. An auxiliary luggage attachment and security tether mechanism as defined in claim 5, further comprising:

a spring cassette comprising:

a hollow cylindrical container, the container defining a slot and having an end wall defining an axial aperture, a plurality of keys extending radially from the container, a coil spring positioned in said container, the coil spring comprising a length of strip metal wrapped in concentric circles upon itself, and the coil spring defining an inner end and an outer end, the outer end positioned in said slot and the inner end bent to form a tab; and wherein the clutch mechanism further comprises an elongated rotatable shaft upon which the strap is wound and unwound, the shaft defining a slot substantially along its length, wherein the tab engages the slot in the shaft to provide rotational biasing between the shaft and the spring when the shaft is received through the spring, and the shaft is further received into the axial aperture to attach the spring cassette to the shaft.

8. An auxiliary luggage attachment and security tether mechanism as defined in claim 5, wherein the clutch mechanism further comprises a rotatable shaft to which the strap is attached and upon which the strap is wound and unwound.

9. An auxiliary luggage attachment and security tether mechanism as defined in claim 8, wherein the clutch mechanism further comprises a gear and ratchet assembly fixably attached to said shaft.

10. An auxiliary luggage attachment and security tether mechanism as defined in claim 9, wherein said clutch mechanism further comprises:

a dog pivotally attached to the housing, the cam surface of the lid engaging the dog at the first and second open position to cause the dog to disengage from the gear and ratchet assembly to allow the shaft to rotate to extend the strap;

a pawl pivotally attached to the housing, the cam surface of the lid engaging the pawl at the second open position to cause the pawl to disengage from the gear and ratchet assembly to allow the shaft to rotate to extend or retract the strap; and the cam surface of the lid disengages from the dog at the closed position to cause the dog to engage the gear and ratchet assembly and thereby prohibit the shaft from rotating.

11. An auxiliary luggage case and security tether mechanism for supporting at least one auxiliary luggage case on a main luggage case, and for securing at least the main luggage case to an object, said attachment and security tether mechanism being fixedly attached to the auxiliary case or to the main case, and comprising:

a housing defining a receptacle;

a clutch mechanism fixedly positioned in and to the receptacle;

an elongated flexible strap having an inner and an outer end, the inner end fixably attached to the clutch mechanism and being extendable and retractable therefrom;

a lid pivotally attached to the housing adjacent to the receptacle and having a selectively first and second open positions where the receptacle is accessible, and having a selectively closed position where the lid covers the receptacle, the lid includes a cam surface positioned for engaging the clutch mechanism in the first and second open positions, and positioned for disengaging from the clutch mechanism when in the closed position; and wherein in the closed position the clutch mechanism prevents extension of the strap therefrom, and wherein in the first open position the strap can be extended from the clutch mechanism, and wherein in the second position the strap can be extended from and retracted onto the clutch mechanism.

12. An auxiliary luggage attachment and security tether mechanism as defined in claim 11, further comprising a hook fixably attached to the outer end of the strap, the hook having a general rigid J-shape defining a tip and a base portion, an upper convex surface, a lower concave surface, and a pair of laterally opposing edges.

13. An auxiliary luggage attachment and security tether mechanism as defined in claim 12, wherein the clutch mechanism further comprises:

a rotatable elongated shaft having a first and second opposing ends to which the strap is attached and upon which the strap is wound and unwound, a gear and ratchet assembly fixably attached to the shaft at the first end, and a rigid circular shaped disc, defining a perimeter, fixably attached to the shaft at the second end; and wherein the opposing lateral edges of the hook engaging the clutch mechanism along one lateral edge and the perimeter of the disc along the other lateral edge when the clutch mechanism is received within the concave surface of the hook.

14. An auxiliary luggage attachment and security tether mechanism as defined in claim 13, wherein said lid further comprises a locking mechanism having a selectable locked and unlocked mode, and the locking mechanism can be locked when the lid is in the closed position.

15. An attachment and security tether mechanism for securing an object to a carrier, said tether mechanism comprising:

an elongated flexible strap having an inner and an outer end;

means attached to a housing and to the inner end of the strap for retracting the strap into the housing;

means attached to the outer end of the strap for fastening the outer end of the strap to the object or for fastening the strap around the object and for fastening the outer end back at said retracting means;

clutch means attached to the housing and to the retracting means for releasing said retracting means whereby the strap may be pulled to an extended position from the housing and for engaging said retracting means to hold the strap in a fixed position in the housing or extended from the housing; and cover means engageable to the housing for controlling access to said retracting means and for controlling said clutch means, said cover means permitting access and releasing said retracting means when in an open position and preventing access to said retracting means and engaging said retracting means when in a closed position so that in the open position the fastening means and strap may be extended to be fastened with the object and in the closed position the fastening means and strap are held in a fixed position with the object fastened thereto.

16. The apparatus of claim 15 and in addition:

means for locking the cover means in the closed position.

17. An auxiliary luggage attachment and security tether mechanism for supporting an auxiliary luggage case on a main luggage case, and for securing at least the main luggage case to an object, said attachment and security tether mechanism being attached to the main case, and comprising:

a clutch mechanism including a rotatable shaft;

means for supporting the rotatable shaft, a spring for powering the rotation of the rotatable shaft on the means for supporting;

an elongated strap having an inner and an outer end, the inner end attached to the rotatable shaft;

a hook attached to the outer end of the strap; the spring being sized to wrap at least a portion of the strap around the rotatable shaft and to pull the hook to the clutch mechanism;

a lid;

a means for mounting the lid adjacent the clutch mechanism for movement between at least two positions, the two positions being an open position permitting manual access to the clutch mechanism and to a portion of the strap pulled to the clutch mechanism and a closed position blocking manual access to the clutch mechanism and to the portion of the strap pulled to the clutch mechanism;

the lid including a surface positioned for selectively engaging the clutch mechanism whereby the clutch mechanism releases the strap to extend from the clutch mechanism when the lid is in one of the two positions, and whereby the clutch mechanism holds the strap from being extended therefrom when the lid is in another of said two positions.

18. The auxiliary luggage attachment and security tether mechanism of claim 17, further comprising:

a lock mechanism in the lid for locking the lid in the closed position.

19. The auxiliary luggage attachment and security tether mechanism of claim 17, wherein:

the lid has selectively first and second open positions permitting manual access;

the surface engages the clutch mechanism in the first open position to release the strap whereby the strap can be extended from the clutch mechanism; and the surface engages the clutch mechanism in the second open position to permit the spring loaded shaft to pull the strap thereon.

20. The auxiliary luggage attachment and security tether mechanism of claim 19 wherein the rotatable shaft comprises a rotatable shaft to which the inner end of the strap is attached and upon which the strap is wound.

21. The auxiliary luggage attachment and security tether mechanism of claim 20, wherein said clutch mechanism further comprises:

a gear and ratchet assembly fixably attached to said rotatable shaft;

a dog mounted on the clutch mechanism, the surface of the lid in the first open position engaging the dog to disengage the dog from the gear and ratchet assembly to allow the shaft to rotate to allow extension of the strap;

a pawl mounted on the clutch mechanism, the surface of the lid in the second open position engaging the pawl to disengage the pawl from the gear and ratchet assembly to allow the spring-loaded shaft to rotate to further extend the strap or to retract the strap; and the surface of the lid disengaged from the dog and pawl in the closed position, and means for biasing the dog and pawl to normally engage the gear and ratchet assembly and prohibit the shaft from rotating.

22. The auxiliary luggage attachment and security tether mechanism of claim 21, further comprising:

a lock mechanism in the lid for locking the lid in the closed position.

23. An auxiliary luggage attachment and security tether mechanism for supporting an auxiliary luggage case on a main luggage case, said attachment and security tether mechanism being attached to the main case, and comprising:

a clutch mechanism including a rotatable shaft, means for supporting the rotatable shaft, a spring for powering the rotation of the rotatable shaft on the means for supporting, the clutch mechanism having a diameter;

an elongated strap having an inner and an outer end, the inner end attached to the rotatable shaft;

a hook attached to the outer end of the strap; the spring being sized to wrap the strap around the rotatable shaft and to pull the hook to the clutch mechanism;

the hook having a general rigid J-shape defining a tip and a base portion and a lower concave surface, the concave surface sized to engage the diameter of the clutch mechanism.

24. The auxiliary luggage attachment and security tether mechanism of claim 23 wherein:

the diameter is formed by a rigid disc attached concentrically to the rotatable shaft and perpendicular to its axis of rotation, whereby the hook is supported at least partially by the rigid disc when the hook is positioned around the rotatable shaft.

* * * * *